US010429766B2

(12) United States Patent
Okubo et al.

(10) Patent No.: US 10,429,766 B2
(45) Date of Patent: Oct. 1, 2019

(54) DEVELOPING APPARATUS HAVING A LARGE CAPACITY TONER STORAGE CHAMBER, AND IMAGE FORMING APPARATUS

(71) Applicant: CANON KABUSHIKI KAISHA, Tokyo (JP)

(72) Inventors: Kazuhiro Okubo, Kawasaki (JP); Jun Miura, Kawasaki (JP); Takaaki Shinkawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/976,187

(22) Filed: May 10, 2018

(65) Prior Publication Data

US 2018/0259879 A1 Sep. 13, 2018

Related U.S. Application Data

(63) Continuation of application No. 15/471,457, filed on Mar. 28, 2017, now Pat. No. 9,996,026.

(30) Foreign Application Priority Data

Mar. 29, 2016 (JP) ..... 2016-065871
Mar. 15, 2017 (JP) ..... 2017-050656

(51) Int. Cl.
*G03G 15/08* (2006.01)

(52) U.S. Cl.
CPC ..... *G03G 15/0865* (2013.01); *G03G 15/0808* (2013.01); *G03G 15/0818* (2013.01); *G03G 15/0896* (2013.01)

(58) Field of Classification Search
CPC ..... G03G 15/0865; G03G 15/0806; G03G 15/0896; G03G 2215/0651; G03G 2215/0653; G03G 2215/0872
(Continued)

(56) References Cited

U.S. PATENT DOCUMENTS 4,445,771 A 5/1984 Sakamoto et al.
5,158,852 A 10/1992 Sakata et al.
9,170,525 B2 10/2015 Adachi et al.

FOREIGN PATENT DOCUMENTS

JP S5965864 A 4/1984
JP S63132966 U 8/1988
(Continued)

OTHER PUBLICATIONS

Office Action issued in U.S. Appl. No. 15/471,457 dated Sep. 25, 2017.
(Continued)

*Primary Examiner* — Robert B Beatty
(74) *Attorney, Agent, or Firm* — Rossi, Kimms & McDowell LLP

(57) ABSTRACT

A developer carrying member is disposed below a storage chamber of a frame and has a surface configured such that a plurality of dielectric portions are dispersed on a conductive portion, an upper region of the storage chamber of the frame is enlarged further in a horizontal direction than a lower region in which the developer carrying member is disposed, and the frame has a lower guide surface and includes a curved surface having a tangent plane inclined at a first angle equal to or greater than a degree of an angle of repose of the developer and less than 90 degrees, in an inner wall of the lower region, and an upper guide surface includes a curved surface having a tangent plane inclined at a second angle that is less than the first angle relative to a horizontal plane in an inner wall of the upper region.

12 Claims, 9 Drawing Sheets

(58) Field of Classification Search
USPC ..... 399/119
See application file for complete search history.

(56) References Cited

FOREIGN PATENT DOCUMENTS

| | | | |
|---|---|---|---|
| JP | H0232381 | A | 2/1990 |
| JP | H0232382 | A | 2/1990 |
| JP | H0431880 | A | 2/1992 |
| JP | H04174470 | A | 6/1992 |
| JP | H0535095 | A | 2/1993 |
| JP | H08115043 | A | 5/1996 |
| JP | H09197823 | A | 7/1997 |
| JP | H10198255 | A | 7/1998 |
| JP | 2000047544 | A | 2/2000 |
| JP | 2002031941 | A | 1/2002 |
| JP | 2007310191 | A | 11/2007 |
| JP | 2014238568 | A | 12/2014 |

OTHER PUBLICATIONS

Notice of Allowance issued in U.S. Appl. No. 15/471,457 dated Feb. 15, 2018.
Office Action issued in Japanese Appln. No. 2017-050656 dated Dec. 18, 2018.
English translation of Office Action issued in Japanese Application No. 2017-050656 dated Dec. 18, 2018 previously cited in IDS filed Jan. 15, 2019.

DEVELOPING APPARATUS HAVING A LARGE CAPACITY TONER STORAGE CHAMBER, AND IMAGE FORMING APPARATUS

BACKGROUND OF THE INVENTION

Field of the Invention

The present invention relates to a developing apparatus that is used in an electrophotographic image forming apparatus.

Description of the Related Art

An image forming apparatus such as a copier or a laser beam printer that forms an image on a recording material using an electrophotographic system forms an electrostatic image (latent image) by applying light corresponding to image data onto an electrophotographic photosensitive member (photosensitive drum) that is uniformly changed by a charging unit. Subsequently, a developing apparatus feeds toner as a developer to the electrostatic image, and the electrostatic image is thereby visualized as a toner image (developer image). The toner image is transferred to the recording material such as recording paper from the photosensitive drum by a transfer apparatus. The toner image transferred to the recording material is fixed onto the recording material by a fixing apparatus.

Japanese Patent Application Laid-open No. H4-31880 describes a developing apparatus in which the surface of a developing roller as a developer carrying member is selectively caused to hold charges and a large number of minute closed electric fields are formed in the vicinity of the surface of the developing roller, whereby toner is fed onto the surface of the developing roller and the developing roller is caused to carry the toner. In addition, Japanese Patent Application Laid-open No. 2014-238568 describes a developing apparatus that is configured such that a guide surface having an inclination angle of at least an angle of repose of toner and less than 90 degrees is provided in an inner wall of a toner storage chamber of a developing container, and the toner slides down the guide surface by its own weight and moves toward the developing roller. According to these configurations, unlike a conventional art, even without providing a toner feed roller for feeding the toner to the developing roller, it becomes possible to feed the toner to the developing roller.

In recent years, due to request from the market, an increase in the capacity of the developing apparatus is desired. However, in the case where the container is designed so as to have a large angle of the inner wall of the container of the developing apparatus in consideration of the maximum angle of repose during use of the toner, the dimensions of the container are increased upwardly in the gravity direction. As a result, a large load is applied to lower toner, the toner having received the load flows in the developing apparatus, and degradation of the toner is thereby accelerated. When the degradation of the toner occurs, a toner attraction effect by the minute closed electric field is reduced. Consequently, image failure is caused by the toner degradation in the latter half of the use period of the developing apparatus, and the convenience of a user may be spoiled.

An object of the present invention is to provide a technique capable of preventing the degradation of the toner and maintaining image quality until the latter half of the use period of the developing apparatus over a long time period while achieving an increase in the storage amount of the toner.

SUMMARY OF THE INVENTION

In order to attain the above object, a developing apparatus of the present invention comprises: a frame in which a developer is stored; and a developer carrying member that is disposed below a storage chamber of the frame, with the developer being stored in the storage chamber, and that carries the developer, the developer carrying member having a surface for carrying the developer that is configured such that a plurality of dielectric portions are dispersed on a conductive portion, wherein an upper region of the storage chamber of the frame is enlarged further in a horizontal direction than a lower region in which the developer carrying member is disposed, and the frame has: a lower guide surface that guides the developer to the developer carrying member and is inclined at a first angle, which is equal to or greater than a degree of an angle of repose of the developer and less than 90 degrees, relative to a horizontal plane in an inner wall of the lower region; and an upper guide surface that is coupled to the lower guide surface, guides the developer to the lower region, and is inclined at a second angle that is less than the first angle relative to the horizontal plane in an inner wall of the upper region.

In order to attain the above object, a developing apparatus of the present invention comprises: a frame in which a developer is stored; and a developer carrying member that is disposed below a storage chamber of the frame, with the developer being stored in the storage chamber, and that carries the developer, the developer carrying member having a surface for carrying the developer that is configured such that a plurality of dielectric portions are dispersed on a conductive portion, wherein an upper region of the storage chamber of the frame is enlarged further in a horizontal direction than a lower region in which the developer carrying member is disposed, and the frame has: a lower guide surface that guides the developer to the developer carrying member and includes a curved surface having a tangent plane that is inclined at a first angle, which is equal to or greater than a degree of an angle of repose of the developer and less than 90 degrees, relative to a horizontal plane in an inner wall of the lower region; and an upper guide surface that is coupled to the lower guide surface, guides the developer to the lower region, and includes a curved surface having a tangent plane that is inclined at a second angle that is less than the first angle relative to a horizontal plane.

In order to attain the above object, a developing apparatus of the present invention comprises: a frame in which a developer is stored; a developer carrying member that is disposed below a storage chamber of the frame, with the developer being stored in the storage chamber, and that carries the developer, the developer carrying member having a surface for carrying the developer that is configured such that a plurality of dielectric portions are dispersed on a conductive portion; and a guide surface that is provided in part of an inner wall of the frame that forms the storage chamber and guides the developer to the developer carrying member, wherein a tangent plane at a lower end of the guide surface is inclined at a first angle, which is equal to or greater than a degree of an angle of repose of the developer and less than 90 degrees, relative to a horizontal plane, and the guide surface has a portion in which a tangent plane is inclined at a second angle that is less than the first angle relative to the horizontal plane above the lower end.

Further features of the present invention will become apparent from the following description of exemplary embodiments (with reference to the attached drawings).

DESCRIPTION OF THE EMBODIMENTS

Hereinafter, a description will be given, with reference to the drawings, of embodiments of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

(First Embodiment)

Figure 2:
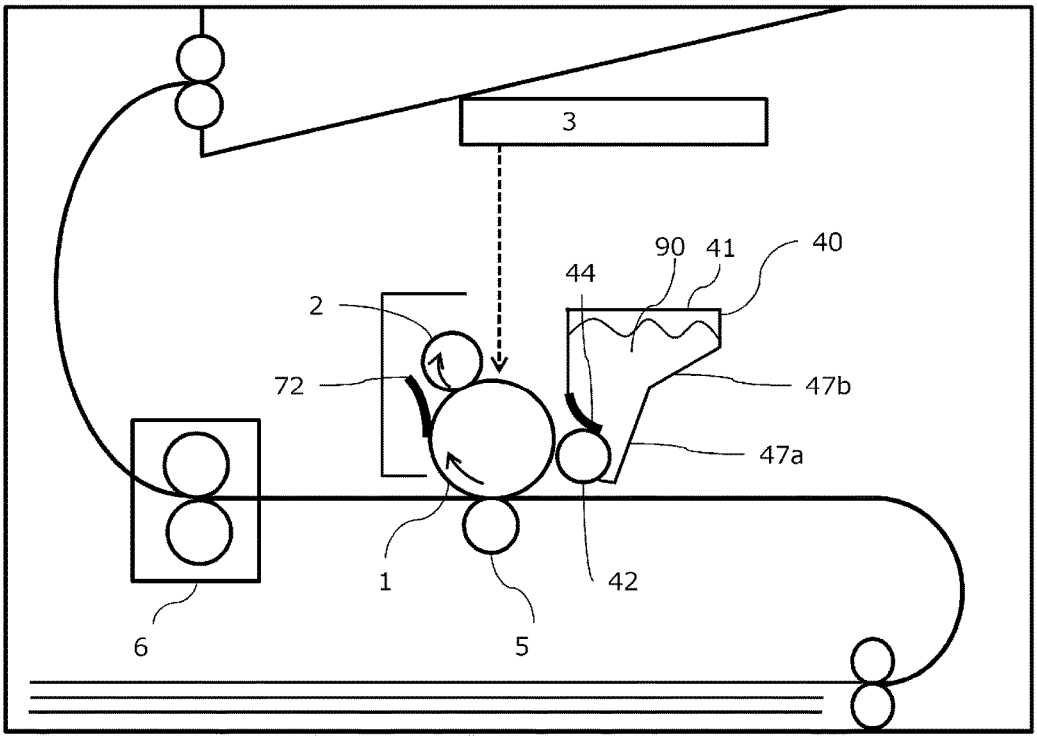
FIG. 2 is a schematic cross-sectional view of an image forming apparatus according to the first embodiment.

FIG. 2 is a schematic cross-sectional view showing the schematic configuration of a laser beam printer as an example of an image forming apparatus according to an embodiment of the present invention. In the image forming apparatus according to the present embodiment, a cylindrical photosensitive drum 1 as an image bearing member is provided so as to rotate about its axis in one direction. In the photosensitive drum 1, its surface is charged uniformly by a charging apparatus 2, and a latent image is then formed by an exposure apparatus 3. In addition, a developing apparatus 40 according to the present embodiment has a frame 41 in which toner 90 is stored as a non-magnetic single-component developer, and feeds the toner 90 to the electrostatic latent image on the photosensitive drum 1 to visualize the electrostatic latent image as a toner image. Thus, the image on the photosensitive drum 1 that is visualized by the toner 90 is transferred to a recording material by a transfer apparatus 5. The recording material is fed by a paper feed roller, and is sent to the transfer apparatus 5 in synchronization with movement of the image on the photosensitive drum 1 by a resist roller (not shown). The image visualized by the toner 90 that is transferred to the recording material is conveyed to a fixing apparatus 6 together with the recording material, is fixed by heat or pressure, and is fixed on the recording material as a recorded image. On the other hand, the developer that remains on the photosensitive drum 1 without being transferred after the transfer is removed by a cleaning blade 72, and is stored in a waste toner container. Thereafter, the surface of the photosensitive drum 1 is charged by the charging apparatus 2 again, and the above-described steps are repeated.

In the developing apparatus 40, an opening portion that extends longitudinally is provided in the frame 41, and a developing roller 42 is provided so as to cover the opening portion. The developing roller 42 is provided so as to rotate at a position opposing the photosensitive drum 1. In the developing roller 42 of the present invention, a dielectric portion and a conductive portion each having a minute area are mixed on its surface. A large number of minute closed electric fields (microfields) are formed in the vicinity of the surface by selectively causing the surface of the developing roller 42 to hold charges, and hence it is possible to cause the surface of the developing roller 42 to carry a large amount of toner and transfer the toner to a developing zone. In addition, the developing apparatus 40 has a regulating blade 44 having elasticity that is provided in the frame 41 so as to be in contact with the surface of the developing roller 42 as a regulating member that regulates the thickness of the layer of the toner 90 carried by the developing roller 42. In addition, the developing apparatus 40 has a flexible sheet 45 that is provided in the frame 41 so as to be in contact with the developing roller 42 in a region different from a region in which the regulating blade 44 is in contact with the developing roller 42, and prevents leakage of the toner 90 from a gap between the opening portion of the frame 41 and the developing roller 42 to the outside of the storage chamber.

More specifically, the image forming apparatus according to the present embodiment has a configuration in which a conventional toner feed/stripping member is omitted in the developing apparatus, and uses gradient force generated by the above-mentioned microfields in order to cause the surface of the developing roller 42 to carry the toner 90 having many layers. Herein, the developing roller 42 used in the present embodiment will be described in detail with reference to FIGS. 3A, 3B, and 3C.

Figure 3A:
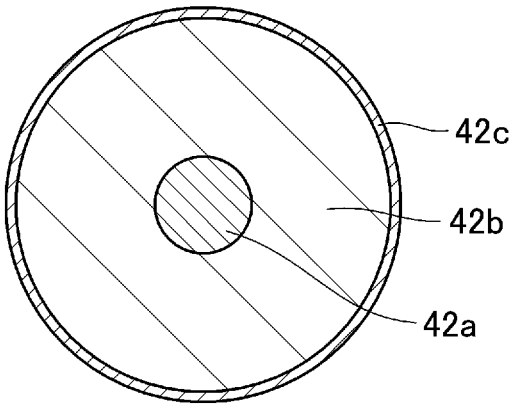
FIGS. 3A, 3B, and 3C are schematic views each showing the configuration of a developing roller in the first embodiment.
Figure 3B:
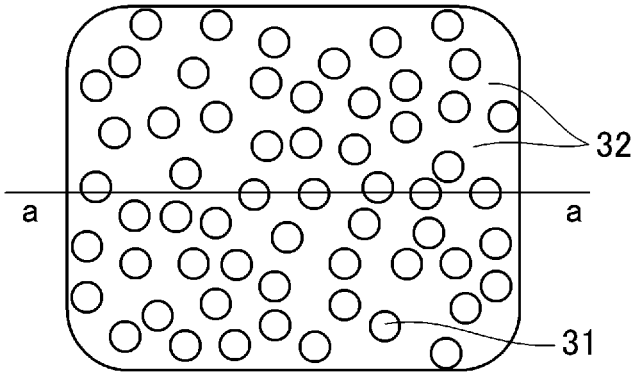
Figure 3C:
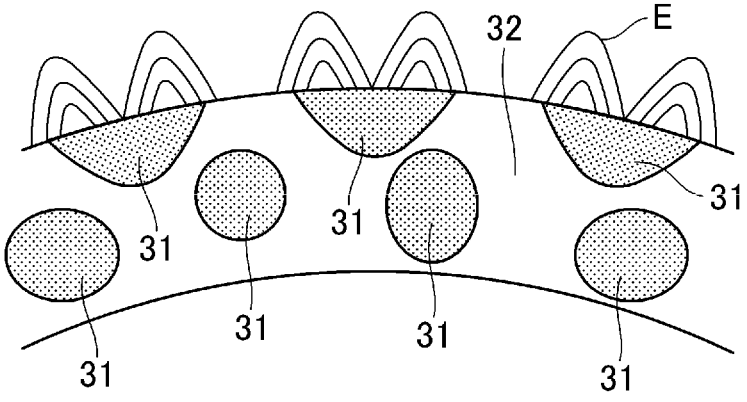

As shown in FIGS. 3A, 3B, and 3C, as the developing roller 42 in the present embodiment, the developing roller in which the carrying surface of the toner 90 is configured such that a plurality of the dielectric portions each having the minute area and capable of holding charges on the surface constituted by the conductive portion are dispersed and exposed is used. Specifically, as shown in FIG. 3A as the schematic cross-sectional view of the developing roller 42, the developing roller 42 has an elastic layer 42*b* made of a conductive rubber material and a surface layer 42*c* on the outer periphery of an axial core 42*a*. It is possible to fabricate the developing roller 42 by forming the surface layer 42*c* formed of a conductive resin material in which dielectric particles are dispersed on the elastic layer 42*b* by, e.g., coating or the like, and polishing the surface of the surface layer 42*c*. FIG. 3B is a plan view of the surface layer 42*c* of the developing roller 42, and FIG. 3C is a cross-sectional view taken along the line a-a of FIG. 3B. By charging a dielectric portion 31 by a predetermined method, as indicated by a line of electric force E in FIG. 3C, a minute closed electric field (microfield) is formed. Thus, the dielectric portion 31 and a conductive portion 32 are provided on the surface of the developing roller 42, the dielectric portion 31 is charged by sliding friction of the regulating blade 44 via the toner 90, and the minute closed electric field indicated by the line of electric force E is formed on a portion adjacent to the conductive portion 32. The toner 90 is attracted to the surface of the developing roller 42 by the gradient force generated by the microfield and is carried by the surface thereof.

The size of the dielectric portion 31 (the size of a portion (circular portion) exposed on the peripheral surface of the developing roller 42 (the conductive portion 32)) is set such that the outer diameter of the dielectric portion 31 is, e.g., about 5 to 500 μm. This is the optimum value for holding charges on the surface and preventing image unevenness. In the case where the outer diameter<5 μm is satisfied, a potential amount held on the surface of the dielectric portion 31 is small, and it is not possible to form sufficient minute closed electric fields. In the case where the outer diameter>500 μm is satisfied, a difference in potential between the dielectric portion 31 and the conductive portion 32 is large, and the image has much unevenness. The dielectric portion 31 needs to maintain the potential difference between the dielectric portion 31 and the conductive portion 32 to a certain degree and maintain the minute closed electric field during a time period from when the dielectric portion 31 passes through a toner layer thickness regulation position by the regulating blade 44 to when the dielectric portion 31 passes through the toner layer thickness regulation position again. In addition, in order to form the minute closed electric field indicated by the line of electric force E in FIG. 3C, the charge amount held by the conductive portion 32 is preferably small. Accordingly, in the present embodiment, the dielectric portion 31 and the conductive portion 32 are configured such that the volume resistance of the dielectric portion 31 is larger than the volume resistance of the conductive portion 32 and a difference between the volume resistances thereof is at least 10^2 Ω·cm. Specifically, the volume resistance of the conductive portion 32 is set to a value of not more than 10^11 Ω·cm, and the volume resistance of the dielectric portion 31 is set to a value of at least 10^13 Ω·cm. Note that the above volume resistance is measured under a 23° C./50% RH environment.

In order to form the surface layer 42*c* shown in FIG. 3A, for example, acrylic resin particles are dispersed in urethane resin as a binder. As a conductive substance used for imparting conductivity to the surface layer 42*c*, it is possible to use carbon black and an ionic conductive material similarly. In the present embodiment, the content of the conductive material of the surface layer 42*c* is set to 0.20 parts by mass with respect to 100 parts by mass of the urethane resin, and the urethane resin portion is thereby caused to function as the conductive portion 32. In addition, in the dielectric portion 31, the acrylic resin particle having an average diameter of 30 μm is used. In the present embodiment, the content of the acrylic resin particle is set to 70 parts by mass with respect to 100 parts by mass of the urethane resin, whereby, in an area ratio of the dielectric portion 31/the conductive portion 32, the area of the dielectric portion 31 occupies about 50% of the total area.

Figure 1:
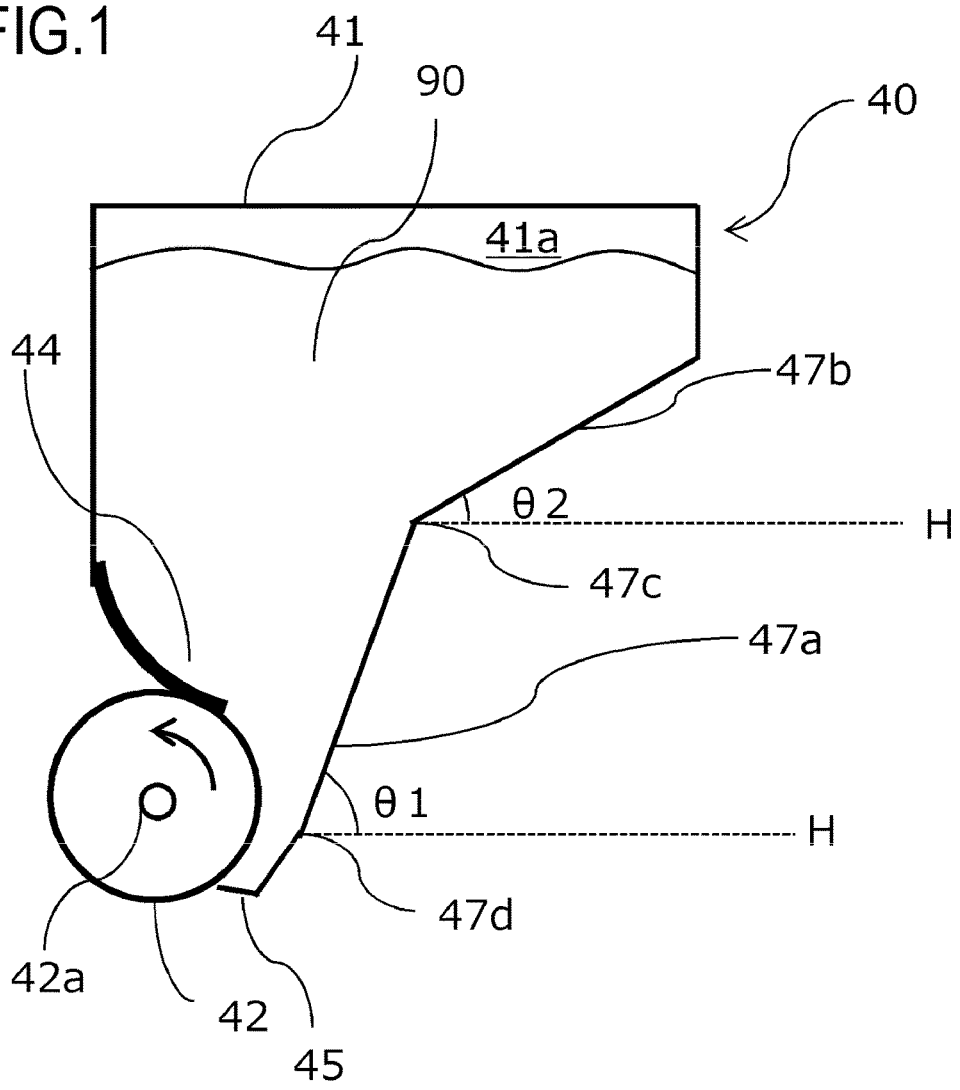
FIG. 1 is a schematic cross-sectional view of a developing apparatus according to a first embodiment.
Figure 4:
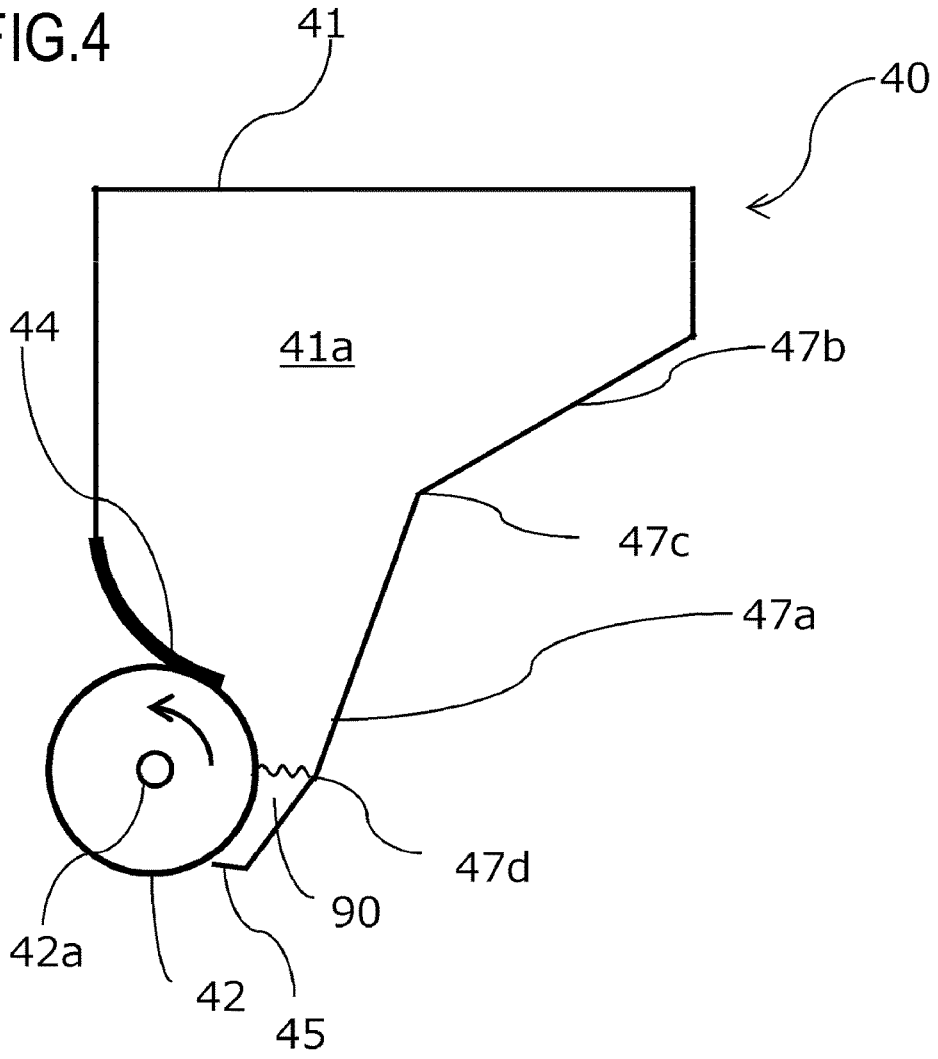
FIG. 4 is a schematic cross-sectional view of the developing apparatus according to the first embodiment.
Figure 5:
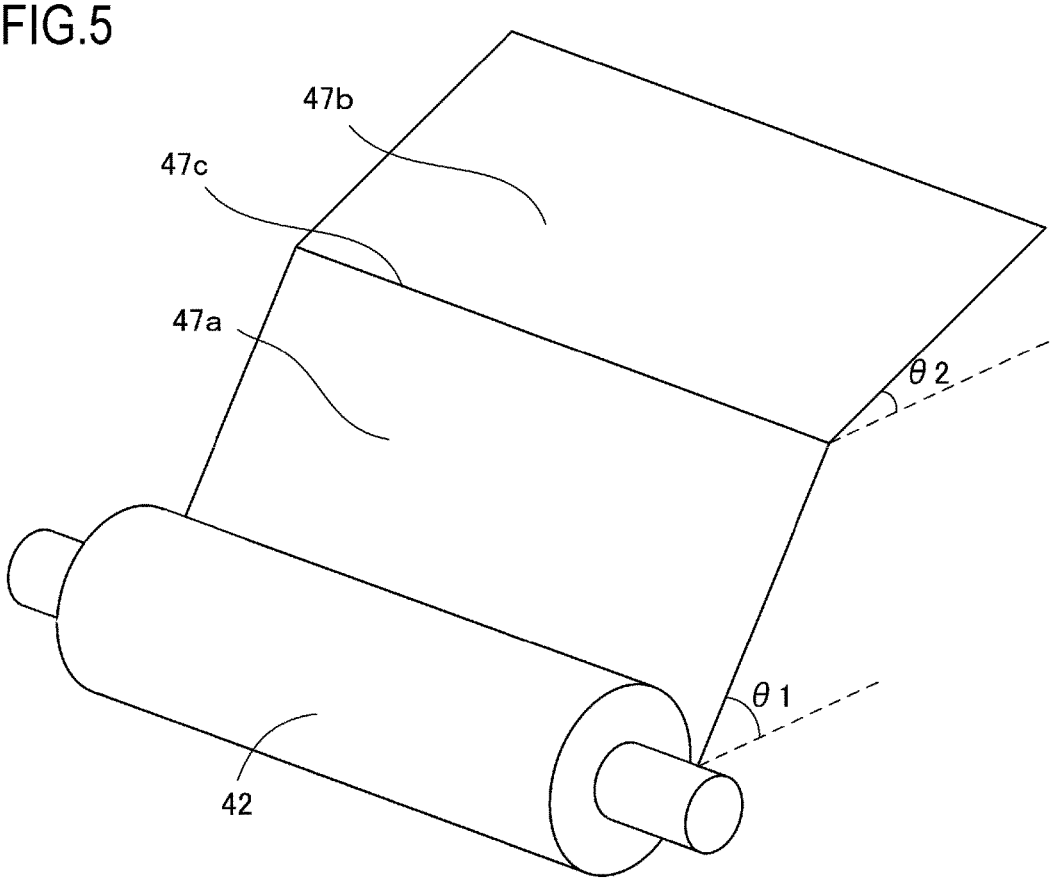
FIG. 5 is a perspective view showing the developing roller and an inclined surface of an inner wall of a storage chamber of a frame in the first embodiment.

The characteristic configuration of the developing apparatus according to the present embodiment will be described with reference to FIGS. 1, 4, and 5. Each of FIGS. 1 and 4 is a schematic cross-sectional view of the developing apparatus according to the present embodiment, and FIG. 5 is a schematic perspective view showing the arrangement of the developing roller and two types of inclined surfaces provided in the inner wall of the developer storage chamber of the frame. Note that a left and right direction in each of FIGS. 1 and 4 corresponds to a horizontal direction, and an up and down direction corresponds to a vertical direction. That is, gravity acts from the upper part to the lower part in the drawing. The same applies to FIGS. 2 and 6 to 9.

The developing apparatus 40 according to the present embodiment has a configuration in which the frame 41 stores the toner 90 above the developing roller 42, and the developing apparatus 40 guides the toner 90 to the vicinity of the developing roller 42 by using inclined surfaces 47*a* and 47*b* provided in the inner wall that forms a toner storage chamber 41*a* (storage chamber) and gravity (by its own weight). Specifically, in the frame 41, the inclined surfaces 47*a* and 47*b* of which an angle changes in two stages are formed from the lower part to the upper part in the toner storage chamber 41*a* as guide surfaces that guide the toner 90 to the developing roller 42 in part of the inner wall that forms the toner storage chamber 41*a*. As shown in FIG. 1, the inclined surface 47*a* as a lower guide surface that guides the toner 90 to the developing roller 42 is formed in the lower region of the toner storage chamber 41*a*. The inclined surface 47*b* as an upper guide surface that guides the toner 90 to the lower region is coupled to upper part of the inclined surface 47*a* and is formed in the upper region of the toner storage chamber 41*a*. The inclination angle is changed so as to gradually get closer to the horizontal direction in an upward direction. That is, the guide surfaces that guide the toner 90 to the developing roller 42 are configured so as to gradually get closer to a horizontal plane in the upward direction. With the configuration described above, the toner storage chamber 41*a* of the frame 41 has a storage space for the developer in which the upper region is enlarged further laterally, i.e., in the horizontal direction than the lower region in which the developing roller 42 as the developer carrying member is disposed.

The magnitude of the inclination angle of the inclined surface 47*a*, i.e., an angle θ1 (corresponds to a first angle) formed by the inclined surface 47*a* and a horizontal plane (a horizontal line in FIG. 1) H is set to 70 degrees. The magnitude of the inclination angle of the inclined surface 47*b*, i.e., an angle θ2 (corresponds to a second angle) formed by the inclined surface 47*b* and the horizontal plane (the horizontal line in FIG. 1) H is set to 30 degrees. These angles are larger than a predetermined angle of repose of the toner 90. With this angle setting, the toner 90 laid on the inclined surface 47*b* is smoothly carried to the inclined surface 47*a* along the inclined surface 47*b*, and the toner 90 laid on the inclined surface 47*a* is smoothly carried to the vicinity of the developing roller 42 along the inclined surface 47*a*. Thus, the toner 90 is carried to the vicinity of the developing roller 42, whereby the developing roller 42 is capable of attracting the toner 90 and carrying the toner 90 on its surface.

Herein, the angle of repose of the toner will be described. The angle of repose of the toner denotes an inclination angle of a ridge of a mountain of the toner formed on a plane when the toner is dropped on the plane. In the present embodiment, the angle of repose thereof is measured by using Powder Tester PT-S (manufactured by Hosokawa Micron Corporation). 150 g of toner is laid on a mesh having an opening of 250 μm, and the toner is accumulated on a circular table having a diameter of 8 cm via a funnel by vibrating the toner on the mesh. At this point, the toner is accumulated to the extent that the toner spills from the end of the table. The angle of repose is determined by measuring an angle formed between the ridge of the toner accumulated on the table and the surface of the circular table. The angle of repose of the toner changes through repeated operation of the developing apparatus. That is, the angle of repose of the toner that remains in the toner storage chamber 41*a* without being used for development of the latent image while the developing apparatus operates in an image forming operation or the like changes as a time period during which the toner remains in the toner storage chamber 41*a* is prolonged. When the toner is not used yet, i.e., in the case where the developing apparatus has never operated since the storage of the toner in the toner storage chamber 41*a*, the angle of repose of the toner is lowest (the angle is smallest). Thereafter, while the developing apparatus performs the image forming operation repeatedly, the toner is degraded and its fluidity is reduced due to, for instance, friction of the toner in the toner storage chamber 41*a* and friction between the toner and the regulating blade 44, and the angle of repose of the toner is increased. Particularly in the case where the remaining amount of the toner is small, the progress of the degradation is accelerated. In the present embodiment, toner subjected to a sphering treatment is used, and the angle of repose of the toner when the toner is not used yet (the toner is new) is about 20 degrees, and the angle of repose of the toner at the time of the end of toner life is about 60 degrees. That is, the range of the angle of repose of the toner in the present embodiment is the range of 20 degrees to 60 degrees.

In the present embodiment, the time of the end of toner life is defined in the following manner. A lower end 47*d* of the inclined surface 47*a* is determined by a toner surface when available toner in the developing apparatus is exhausted (hereinafter referred to as the end of toner life). This is shown in FIG. 4. Note that the lower end 47*d* may also be provided at a position lower than the toner surface at the time of the end of toner life. When a printing operation is repeated and the toner in the developing apparatus 40 is reduced, the toner that can be carried by the developing roller 42 is exhausted anyway, and the development can no longer be performed. In the present embodiment, a point of time when a toner laid-on level per unit area on the photosensitive drum 1 exhibits a predetermined change when a solid image of about 287 mm (each of front and rear end margins is 5 mm in a sheet of paper in an A4 format) is developed in a direction of rotation of the photosensitive drum 1 is defined as the end of toner life. Specifically, the normal toner laid-on level (at a point of time when the use of the toner is started) is 0.4 to 0.5 mg/cm$^2$, and a point of time when the toner laid-on level is reduced to 0.2 mg/cm$^2$ or less is defined as the end of toner life. As a simpler test method, a point of time when blurring is visually recognized on the solid image after fixation may also be defined as the end of toner life. Thus, by measuring the angle of repose of the toner having reached the end of toner life by the above-described measurement method, it is possible to obtain the angle of repose at the end of toner life.

The inclined surface 47*a* as the lower guide surface is extended upwardly at an angle of 70 degrees from the lower end 47*d* that corresponds to the height of the surface of the toner when the toner has reached the end of toner life. The lower end 47*d* of the inclined surface 47*a* is positioned above the lower end of the developing roller 42 and below the central axis of the rotation of the developing roller 42. In addition, the lower end 47*d* of the inclined surface 47*a* is positioned below a position at which the regulating blade 44 is in contact with the developing roller 42 and the tip (lower end) of the regulating blade 44 that is in contact with the developing roller 42. The inclination angle (first angle) of the inclined surface 47*a* may be at least the angle of repose at the time of the end of toner life as a first angle of repose (at least 60 degrees in the present embodiment) and less than 90 degrees and, the setting range in the present embodiment is at least 60 degrees and not more than 80 degrees. Herein, as described above, the angle of repose at the time of the end of toner life is the angle of repose of the toner that remains in the toner storage chamber 41*a* when the developing apparatus has performed the image forming operation the number of times that causes the reduction in the toner laid-on level as the predetermined number of times since the storage of the toner in the toner storage chamber 41*a*. The inclined surface 47*a* is extended upwardly at an angle of 70 degrees, and is coupled to the inclined surface 47*b*.

The inclined surface 47*b* as the upper guide surface is extended further upwardly at an angle of 30 degrees from the upper end of the inclined surface 47*a* as the lower guide surface. The inclination angle (second angle) of the inclined surface 47*b* may be at least the angle of repose when the toner is not used yet as a second angle of repose (at least 20 degrees in the present embodiment) and less than the first angle of repose, and the setting range is at least 20 degrees and not more than 40 degrees in the present embodiment. Herein, as described above, the angle of repose when the toner is not used yet is the angle of repose of the toner in the case where the developing apparatus has never performed the image forming operation since the storage of the toner in the toner storage chamber 41*a*.

That is, as described above, the angle θ1 formed by the inclined surface 47*a* and the horizontal plane (the horizontal line in FIG. 1) H is set to 70 degrees, and is not less than the angle of repose of the toner at the time of the end of toner life. In addition, the angle θ2 formed by the inclined surface 47*b* and the horizontal plane (the horizontal line in FIG. 1) H is set to 30 degrees, and is at least the angle of repose of toner when the toner is not used yet (the toner is new) and less than the angle of repose of the toner at the time of the end of toner life. Further, the inclination angle of the inclined surface 47*b* is less than the inclination angle of the inclined surface 47*a*.

When the remaining amount of the toner is large, the toner degradation is small and the angle of repose is low. When the developing apparatus repeats the image forming operation and the remaining amount of the toner is reduced, the toner degradation progresses and the angle of repose is increased. In order to cause the toner to move to the developing roller 42 by its own weight, it is preferable that the inclined surface on which the toner is laid is inclined at an angle suitable for the current state of the toner, i.e., it is preferable to maintain an angle of at least the predetermined angle of repose in accordance with the remaining amount and the degradation degree of the toner.

A boundary between the upper region and the lower region in the toner storage chamber 41*a* of the frame 41 of the developing apparatus 40 is set in the following manner in the present embodiment. The height of a boundary portion 47*c* between the inclined surface 47*a* and the inclined surface 47*b* (the upper end of the inclined surface 47*a* or the lower end of the inclined surface 47*b*) is set to a height substantially equal to the height of the toner surface when the toner in an amount corresponding to half (50%) of the maximum capacity of the toner storage chamber 41*a* of the frame 41 is stored in the toner storage chamber 41*a*. In the toner storage chamber 41*a*, a space region below the horizontal plane passing through the boundary portion 47*c* serves as the lower region, and a space region above the horizontal plane serves as the upper region, and the horizontal plane that separates the two regions from each other serves as the boundary.

With the configuration described above, each of the inclined surfaces 47*a* and 47*b* of the inner wall of the toner storage chamber 41*a* maintains the inclination angle of at least the desired angle of repose corresponding to the remaining amount and the degradation degree of the toner stored in the toner storage chamber 41*a*, and hence it is possible to smoothly slide and carry the toner to the developing roller 42.

Figure 9:
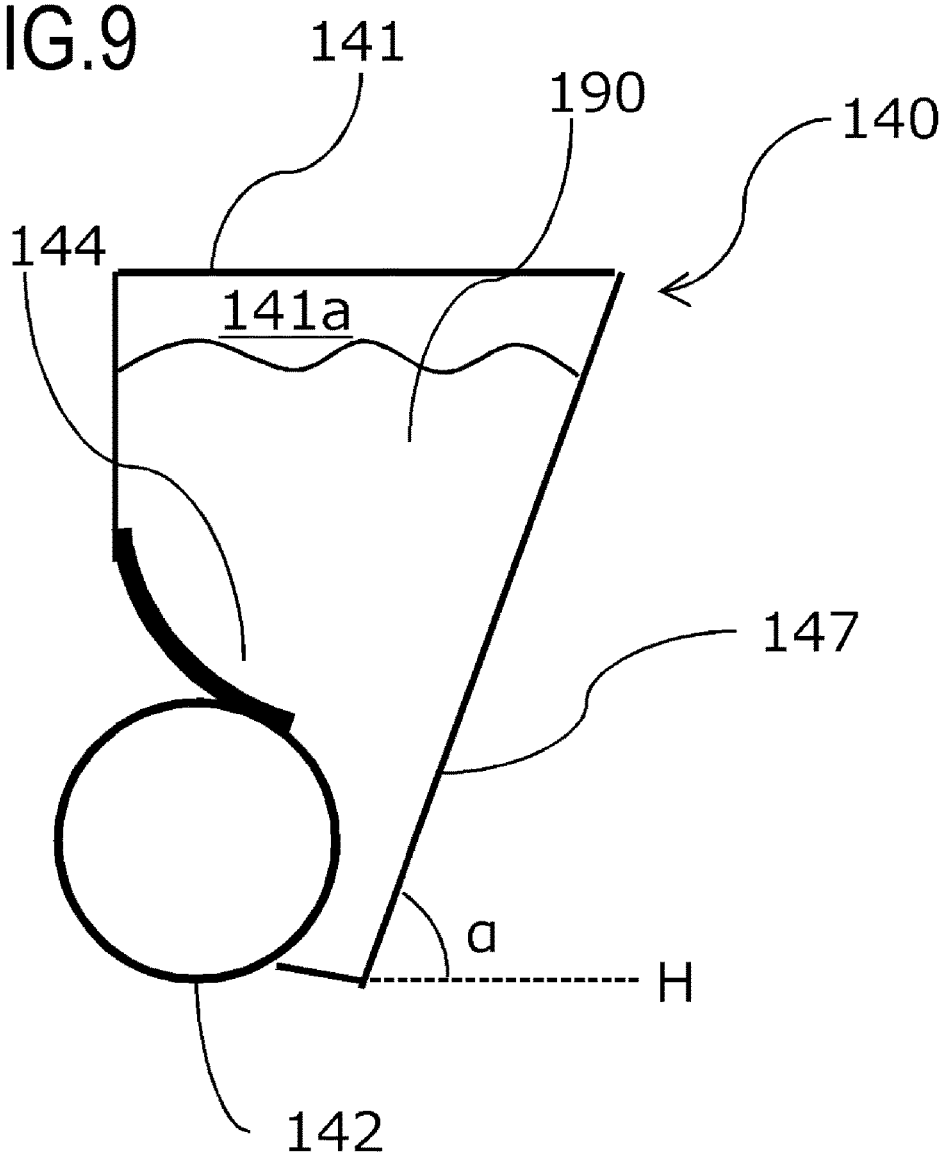
FIG. 9 is a schematic cross-sectional view of a developing apparatus according to a comparative example.

Herein, as a comparative example, FIG. 9 shows a schematic cross-sectional view of a developing apparatus that includes a virtual configuration. A developing apparatus 140 shown in FIG. 9 includes a frame 141 in which toner 190 is stored, a developing roller 142 that is disposed so as to cover a lower opening of a toner storage chamber 141*a* of the frame 141, and a regulating blade 144 that regulates the toner amount carried by the developing roller 142. The frame 141 has an inclined surface 147 for guiding the toner 190 to the developing roller 142 in the inner wall of the toner storage chamber 141*a*. The magnitude of the inclination angle of the inclined surface 147, i.e., an angle α formed by the inclined surface 147 and the horizontal plane (the horizontal line in FIG. 9) H is set to 70 degrees. This angle has a value of at least the angle of repose of the toner 190. Accordingly, the toner 190 is smoothly carried to the developing roller 142 along the inclined surface 147 by its own weight. On the other hand, the developing roller 142 has a minute dielectric portion on its surface, and a large number of minute closed electric fields are formed in the vicinity of the surface. Consequently, the toner 190 is carried to the vicinity of the developing roller 142 by the inclined surface 147 and the toner 190 is attracted by the minute closed electric fields on the surface of the developing roller 142, whereby it is possible to cause the surface of the developing roller 142 to carry the toner 190.

However, the developing apparatus having the virtual configuration that includes the developing roller that partially has charges on the surface and has the operation of attracting the toner, and the inner wall that has the angle of at least the angle of repose of the toner and guides the toner to the vicinity of the developing roller is considered to have the following problem. An increase in the capacity of the developing apparatus is desired and, in the case where the container is designed so as to have a large angle of the inner wall of the container of the developing apparatus in consideration of the maximum angle of repose during the use of the toner, the dimensions of the container are increased upwardly in the gravity direction. As a result, a large load is applied to lower toner, the toner having received the load flows in the developing apparatus, and degradation of the toner is thereby accelerated. When the degradation of the toner occurs, a toner attraction effect by the minute closed electric field is reduced. Consequently, image failure is caused by the toner degradation in the latter half of the use period of the developing apparatus, and the convenience of a user may be spoiled.

As described above, according to the present embodiment, the inclination angle θ2 of the upper inclined surface 47*b* is smaller than the inclination angle θ1 of the lower inclined surface 47*a*, and the toner storage chamber 41*a* is configured such that the storage space is enlarged laterally (horizontal direction) in the upward direction. Consequently, in the case where the toner in a large amount close to the maximum capacity of the toner storage chamber 41*a* is stored, according to the present embodiment, it is possible to make the height of the toner surface lower than that in the configuration in which the storage space extends vertically, as in the configuration shown in FIG. 9 (the configuration in which the toner is accumulated longitudinally). With this, it is possible to reduce influence of the weight of the upper toner on the lower toner in the toner storage chamber 41*a*, and prevent the acceleration of the toner degradation by the weight of the toner. By preventing the acceleration of the toner degradation, it is possible to maintain image quality until the latter half of the use period of the developing apparatus, and improve the convenience of the user.

For instance, the above-described setting of the inclination angle of each of the inclined surfaces 47*a* and 47*b* and the above-described setting of the position (height) of the boundary portion 47*c* between the inclined surfaces 47*a* and 47*b* are only exemplary. It goes without saying that there are cases where the optimum set values are changed in accordance with, for instance, the type of the stored toner and the capacity of the toner storage chamber 41*a*, and are appropriately set in accordance with the specifications of the apparatus. In particular, with regard to the position (height) of the boundary portion 47*c* between the inclined surface 47*a* and the inclined surface 47*b* where the inclination angle is changed, the optimum set value thereof may be determined by actually measuring the transition of the change of the angle of repose of the toner resulting from an increase in the number of times of use of the developing apparatus. Alternatively, the optimum set value may also be determined by preparing a plurality of developing apparatuses having different inclination angles of the inclined surfaces and checking the toner remaining amount in the latter half of the use period of the developing apparatus and comparing the toner remaining amounts with each other.

In addition, in the present embodiment, the guide surface for guiding the toner to the developing roller is formed of two inclined surfaces, but the number of the inclined surfaces is not limited to two. A configuration in which the guide surface is formed of three or more inclined surfaces, i.e., the guide surface having the inclination angle that changes in three or more stages is provided may also be adopted. The boundary (inner wall height) of the change of the inclination angle in this case may be appropriately set such that the inclination angle of the inclined surface on which the toner is laid changes to an optimum angle in accordance with the remaining amount and the degradation degree of the toner (the change of the angle of repose).

The developing apparatus according to the present embodiment may be configured to be detachable from the apparatus main body of the image forming apparatus (the portion of the image forming apparatus other than the developing apparatus), or may also be configured to be fixed to the apparatus main body so as not to be detachable therefrom. In addition, the developing apparatus 40 may constitute a process cartridge together with the photosensitive drum 1 and the charging apparatus 2, and the developing apparatus may also be configured to be detachable from the apparatus main body of the image forming apparatus as part of the process cartridge.

(Second Embodiment)

Figure 6:
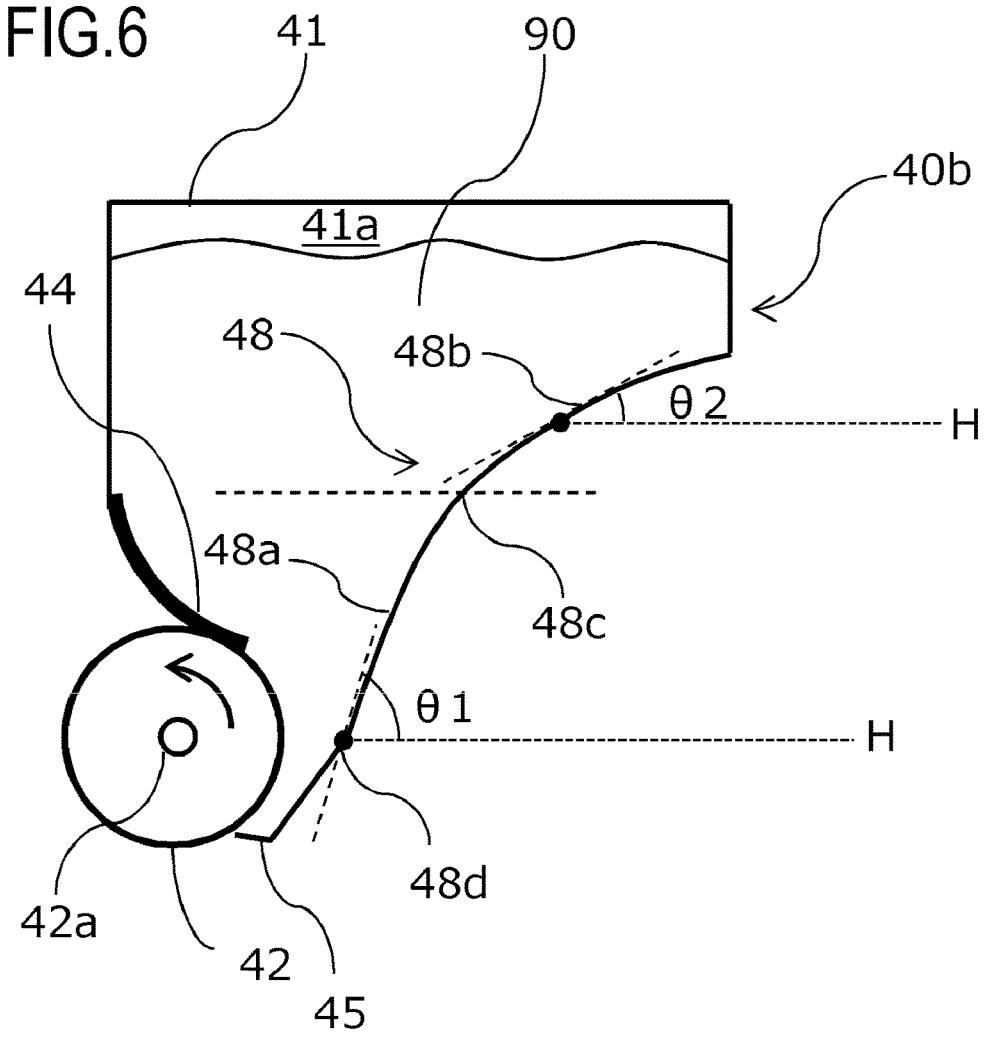
FIG. 6 is a schematic cross-sectional view of a developing apparatus according to a second embodiment.

A developing apparatus according to a second embodiment of the present invention will be described with reference to FIG. 6. FIG. 6 is a schematic cross-sectional view of the developing apparatus according to the second embodiment. In the developing apparatus according to the second embodiment, the guide surface for guiding the toner to the developing roller is constituted by a curved surface. Other than the configuration of the guide surface, the developing apparatus according to the second embodiment has the same configuration as that of the developing apparatus according to the first embodiment. In the second embodiment, configurations common to the first embodiment are designated by the same reference numerals as those in the first embodiment, and the description thereof will be omitted. Matters that are not described in the second embodiment are the same as those in the first embodiment.

As shown in FIG. 6, a developing apparatus 40*b* according to the second embodiment has a guide surface 48 as a curved surface that is convex toward the inside of the storage chamber in part of the inner wall that forms the toner storage chamber 41*a* of the frame 41. The guide surface 48 is a curved surface that is curved and extended upwardly from a lower end 48*d* that is provided at the same height (position) as that of the lower end 47*d* of the inclined surface 47*a* in the first embodiment while gradually reducing its angle relative to the horizontal plane. That is, in the guide surface 48, the angle relative to the horizontal plane is maximized at the lower end 48*d* (θ1=70 degrees), and the angle is gradually reduced as the height increases. The guide surface 48 is formed such that its inclination angle changes in a range of at least 60 degrees and not more than 80 degrees so as to be at least the angle of repose at the time of the end of toner life in a region close to the lower end 48*d*. The guide surface 48 is formed such that the inclination angle changes in a range of at least 20 degrees and less than 60 degrees so as to be at least the angle of repose when the toner is not used yet in a region away from the lower end 48*d* of the guide surface 48, i.e., an upper region, and the region includes a portion in which θ2=30 degrees is satisfied. That is, in the guide surface 48, a tangent plane at the lower end is inclined at an angle of at least the first angle of repose relative to the horizontal plane. In addition, the guide surface 48 has a portion in which the tangent plane is inclined at an angle of at least the second angle of repose that is smaller than the first angle of repose and less than the first angle of repose relative to the horizontal plane above the lower end. The guide surface 48 is a curved surface that is curved and extended such that the angle formed by the tangent plane relative to the horizontal plane is gradually reduced from the first angle of repose upwardly from the lower end. Further, the tangent plane of the upper end of the guide surface 48 is inclined at an angle of at least the second angle of repose relative to the horizontal plane.

Consideration will be given to the guide surface 48 by determining, as a boundary portion 48*c*, a line at substantially the same height as that of the toner surface when the toner in an amount corresponding to half (50%) of the maximum capacity of the toner storage chamber 41*a* of the frame 41 is stored in the toner storage chamber 41*a*, and dividing the guide surface 48 into a lower curved surface 48*a* and an upper curved surface 48*b*. The curved surface 48*a* as a lower guide surface is a curved surface in which an angle θ1 (corresponding to the first angle) formed by the tangent plane in contact with the curved surface at any height and the horizontal plane falls within a range of at least 60 degrees and not more than 80 degrees, and is capable of obtaining the same effect as that of the lower inclined surface 47*a* in the first embodiment. The curved surface 48*b* as an upper guide surface is a curved surface in which an angle θ2 (corresponding to the second angle) formed by the tangent plane in contact with the curved surface at any height and the horizontal plane falls within a range of at least 20 degrees and less than 60 degrees, and is capable of obtaining the same effect as that of the upper inclined surface 47*b* in the first embodiment. That is, it is possible to consider that, in the guide surface 48, the two different curved surfaces 48*a* and 48*b* form one continuous curved surface. That is, the curved surface 48*a* as the lower guide surface has the tangent plane that is inclined at an angle of at least the first angle of repose. The curved surface 48*b* as the upper guide surface has the tangent plane that is inclined at an angle of less than the first angle of repose and at least the second angle of repose relative to the horizontal plane. The inclination angle of the tangent plane of the curved surface 48*b* as the upper guide surface is less than the inclination angle of the tangent plane of the curved surface 48*a* as the lower guide surface.

In the guide surface 48, an angle formed by the guide surface 48 and the horizontal plane is increased in a downward direction. When the developing apparatus 40*b* repeats the printing operation, the toner 90 stored in the toner storage chamber 41*a* of the frame 41 is reduced while being degraded, and hence the angle of repose of the stored toner is increased as the toner surface is lowered. On the other hand, in a state in which the toner surface is high and the use of the toner is just started, the fluidity of the toner is high, and the angle of repose thereof is low. According to the present embodiment, the guide surface 48 maintains the inclination angle of at least the desired angle of repose corresponding to the remaining amount and the degradation degree of the toner, and hence it is possible to smoothly slide and carry the toner to the developing roller 42 over a long use period. In addition, the toner storage chamber 41*a* is configured such that the storage space is enlarged laterally (the horizontal direction) in the upward direction by the guide surface 48. With this, it is possible to reduce the influence of the weight of the upper toner on the lower toner in the toner storage chamber 41*a*, and prevent the acceleration of the toner degradation by the weight of the toner. By preventing the acceleration of the toner degradation, it is possible to maintain the image quality until the latter half of the use period of the developing apparatus, and improve the convenience of the user.

In the present embodiment, the guide surface 48 is the curved surface that forms a curve in which the degree of the change of the inclination angle is constant in a cross-sectional shape when viewed in the rotation axis direction of the developing roller 42, but other various configurations can be adopted as long as the configurations are capable of achieving the guide effect of the toner described above. For example, the guide surface 48 may also be a curved surface that forms a curve in which the inclination angle falls within the predetermined range of the angle of repose but the degree of the change of the inclination angle is irregular in the cross-sectional shape described above.

(Third Embodiment)

Figure 7:
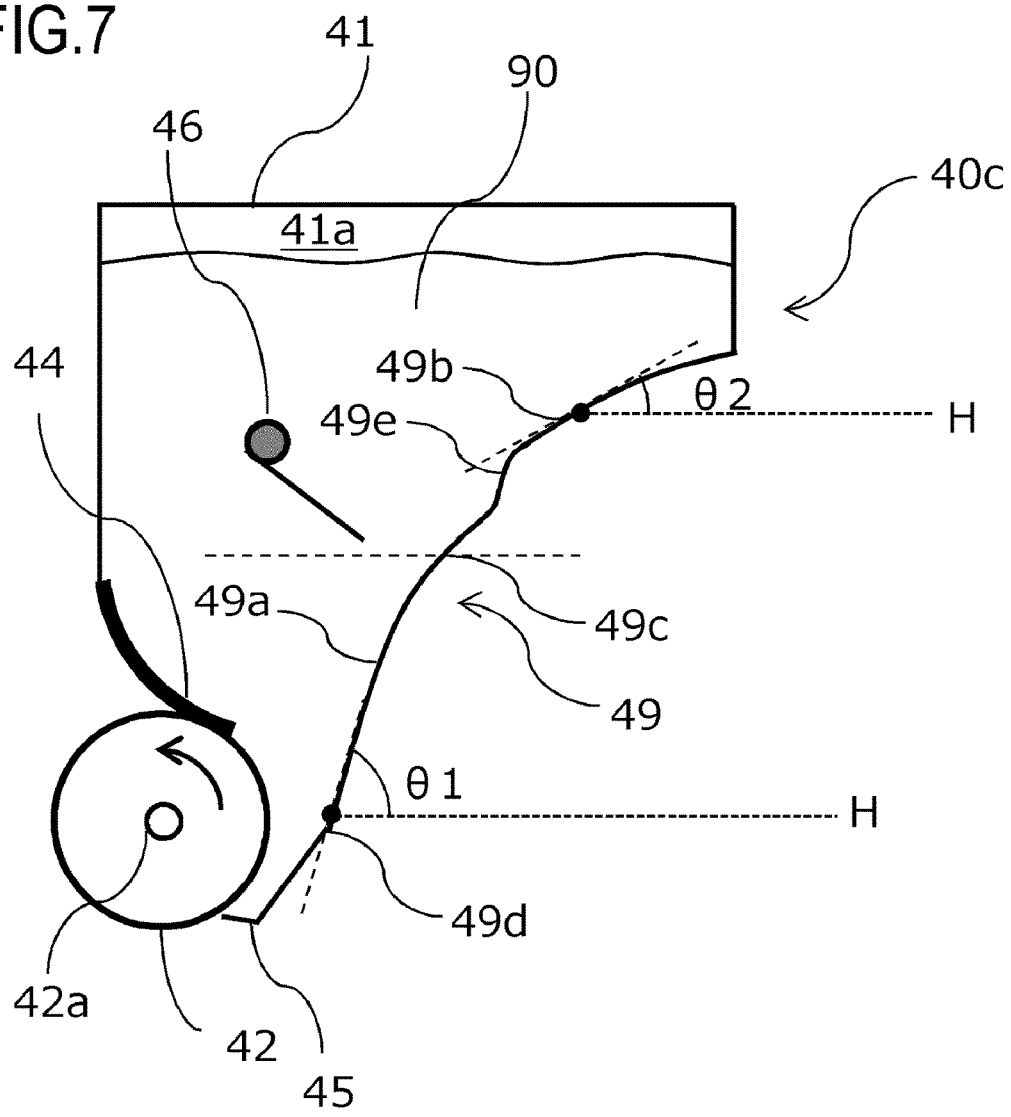
FIG. 7 is a schematic cross-sectional view of a developing apparatus according to a third embodiment.

A developing apparatus according to a third embodiment of the present invention will be described with reference to FIG. 7. FIG. 7 is a schematic cross-sectional view of the developing apparatus according to the third embodiment. In the developing apparatus according to the third embodiment, unlike the guide surface of the second embodiment, the guide surface for guiding the toner to the developing roller is constituted by an irregularly curved surface. Other than the configuration of the guide surface, the developing apparatus according to the third embodiment has the same configuration as that of the developing apparatus according to each of the first and second embodiments. In the third embodiment, configurations common to the first and second embodiments are designated by the same reference numerals as those in the first and second embodiments, and the description thereof will be omitted. Matters that are not described in the third embodiment are the same as those in the first and second embodiments.

As shown in FIG. 7, a developing apparatus 40*c* according to the third embodiment has a guide surface 49 of which the shape irregularly changes from the lower part of the storage chamber to the upper part thereof in part of the inner wall that forms the toner storage chamber 41*a* of the frame 41. Upwardly from a lower end 49*d*, the guide surface 49 has a lower curved surface 49*a*, a boundary portion 49*c* positioned at the same height of that of the surface of the toner in an amount corresponding to half of the maximum capacity of the toner storage chamber 41*a*, and an upper curved surface 49*b*. In the guide surface 49, an angle formed by the lower surface and the horizontal plane is larger than an angle formed by the upper surface and the horizontal plane, but the guide surface 49 has a portion 49*e* having a sharp angle in part thereof (the upper curved surface 49*b* in the present embodiment). That is, the guide surface 49 is a curved surface that includes a portion in which the change of the angle formed by the tangent plane relative to the horizontal plane is irregular. Even the guide surface 49 having such a discontinuously curved portion maintains the inclination angle of at least the desired angle of repose corresponding to the remaining amount and the degradation degree of the toner, and hence it is possible to transfer the toner to the developing roller 42 by the weight of the toner and the guide surface 49 over a long use period.

Figure 8:
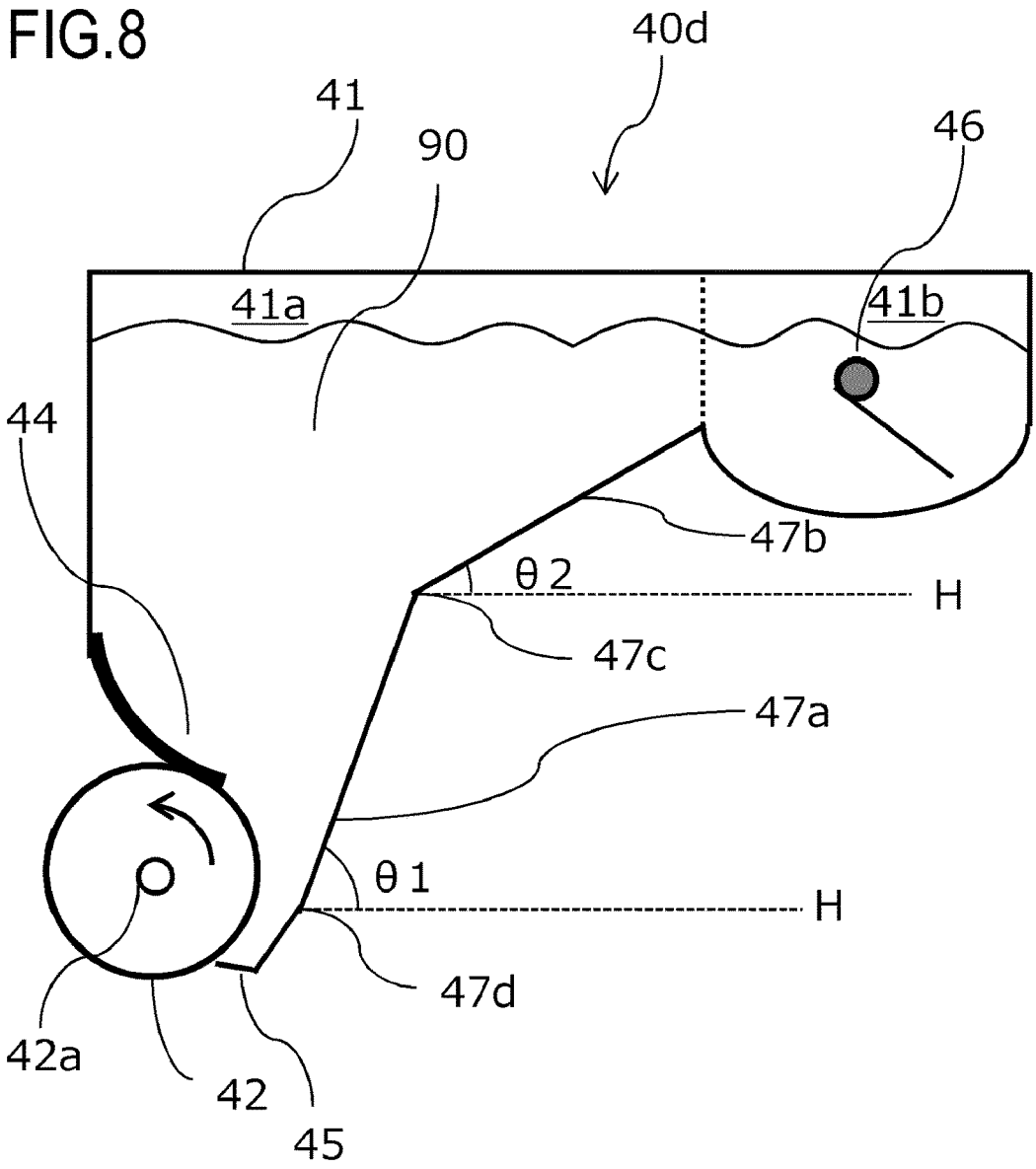
FIG. 8 is a schematic cross-sectional view of a developing apparatus according to a modification of the third embodiment.

In addition, as shown in FIG. 7, the developing apparatus 40*c* according to the present embodiment includes a stirring member 46 in the toner storage chamber 41*a* of the frame 41. The stirring member 46 is a member that aids the movement of the toner in the storage camber with its own weight by rotating in the toner storage chamber 41*a*. As shown in FIG. 8, as the configuration of the developing apparatus, a configuration in which a second toner storage chamber 41*b* in which the stirring member 46 is rotatably disposed is provided on the depth side (the side of a region away from the developing roller 42) of the toner storage chamber 41*a* of the frame 41 may also be adopted. FIG. 8 is a schematic cross-sectional view of a developing apparatus 40*d* according to a modification of the third embodiment. In the developing apparatus having the configuration in which the member for aiding the movement of the toner in the storage chamber is provided, by providing the guide surface of the present invention that facilitates the movement by the weight of the toner, it is possible to obtain the toner degradation prevention effect described above.

According to the present embodiment, the guide surface 49 maintains the inclination angle of at least the desired angle of repose corresponding to the remaining amount and the degradation degree of the toner, and hence it is possible to smoothly slide and carry the toner to the developing roller 42 over a long use period. In addition, the toner storage chamber 41*a* is configured such that the storage space is enlarged laterally (in the horizontal direction) in the upward direction by the guide surface 49. With this, it is possible to reduce the influence of the weight of the upper toner on the lower toner in the toner storage chamber 41*a*, and prevent the acceleration of the toner degradation by the weight of the toner. By preventing the acceleration of the toner degradation, it is possible to maintain the image quality unit the latter half of the use period of the developing apparatus, and improve the convenience of the user.

With regard to the embodiments described above, the individual configurations may be combined with each other whenever possible. For example, a configuration in which the guide surface obtained by combining the flat inclined surface in the first embodiment with the curved surface in the second embodiment is provided may be adopted. Note that, in the case where the flat inclined surface is used, the tangent plane corresponds to the inclined surface.

According to the present invention, it is possible to prevent the degradation of the toner and maintain the image quality until the latter half of the use period of the developing apparatus over a long time period while achieving an increase in the storage amount of the toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-065871, filed Mar. 29, 2016, and No. 2017-050656, filed Mar. 15, 2017, which are hereby incorporated by reference herein in their entirety.

What is claimed is:

1. A developing apparatus comprising:

a frame including:

a first surface including a first curved surface having a tangent plane that is inclined at a first angle relative to a horizontal plane in an installed state where the developing apparatus is installed in an image forming apparatus; and a second surface including a second curved surface having a tangent plane that is inclined at a second angle less than the first angle relative to a horizontal plane, the second surface being coupled to the first surface so that the second surface is positioned above the first surface in the installed state; and a developer carrying member including a surface configured so that a plurality of dielectric portions is dispersed on a conductive portion, and which is rotatably supported by the frame at a lower side of the fame in the installed state, wherein a developer stored in a storage chamber formed by the frame has a first angle of repose of the developer in a case where the developer stored in the storage chamber has been used in an image forming operation for a predetermined number of times, and a second angle of repose of the developer in a case the developer stored in the storage chamber has never been used in the image forming operation, and wherein the second angle is equal to or greater than a degree of the second angle of repose of the developer, relative to a horizontal plane.

2. The developing apparatus according to claim 1, wherein the lower end of the first surface is positioned to be higher than a lower end of the developer carrying member at the installed state.

3. The developing apparatus according to claim 1, wherein the lower end of the first surface is positioned to be lower than a level surface of a developer remaining in the storage chamber when the developer in the storage chamber is determined to be exhausted.

4. The developing apparatus according to claim 1, wherein the storage chamber for storing the developer is formed by a first frame portion and a second frame portion of the frame.

5. The developing apparatus according to claim 1, wherein the first surface includes a planar surface.

6. The developing apparatus according to claim 1, wherein the second surface includes a planar surface.

7. The developing apparatus according to claim 5, wherein the second surface includes a planar surface.

8. The developing apparatus according to claim 1, wherein the frame includes a third surface, the third surface being coupled to the first surface so that the third surface is positioned below the first surface in the installed state.

9. A developing apparatus comprising:

a frame including:

a first surface inclined at a first angle relative to a horizontal plane in an installed state where the developing apparatus is installed in an image forming apparatus; and a second surface inclined at a second angle less than the first angle relative to a horizontal plane, the second surface being coupled to the first surface so that the second surface is positioned above the first surface in the installed state; and a developer carrying member including a surface configured so that a plurality of dielectric portions is dispersed on a conductive portion, and which is rotatably supported by the frame at a lower side of the fame in the installed state, wherein, a lower end of the first surface is positioned to be lower than a rotational axis of the developer carrying member in the installed state, and wherein the frame includes a third surface, the third surface being coupled to the first surface so that the third surface is positioned below the first surface in the installed state, wherein a developer stored in a storage chamber formed by the frame has a first angle of repose of the developer in a case where the developer stored in the storage chamber has been used in an image forming operation for a predetermined number of times, and a second angle of repose of the developer in a case the developer stored in the storage chamber has never been used in the image forming operation, and wherein the second angle is equal to or greater than a degree of the second angle of repose of the developer, relative to a horizontal plane.

10. The developing apparatus according to claim 1, wherein a lower end of the first surface is positioned to be lower than a rotational axis of the developer carrying member in the installed state.

11. The developing apparatus according to claim 1, wherein the first angle is equal to or greater than a degree of the first angle of repose of the developer but less than 90 degrees, relative to a horizontal plane.

12. The developing apparatus according to claim 9, wherein the first angle is equal to or greater than a degree of the first angle of repose of the developer but less than 90 degrees, relative to a horizontal plane.

* * * * *